US011493866B2

(12) United States Patent
Clayburn et al.

(10) Patent No.: US 11,493,866 B2
(45) Date of Patent: Nov. 8, 2022

(54) HEATED PRESSURE ROLLER ASSEMBLIES FOR PRINTERS

(71) Applicant: Hewlett-Packard Development Company, L.P., Spring, TX (US)

(72) Inventors: Jody L Clayburn, Vancouver, WA (US); Lorraine T Golob, Vancouver, WA (US); Daniel James Magnusson, Vancouver, WA (US); Brooke Hoyer, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 121 days.

(21) Appl. No.: 17/047,634

(22) PCT Filed: Jun. 8, 2018

(86) PCT No.: PCT/US2018/036785

§ 371 (c)(1),
(2) Date: Oct. 14, 2020

(87) PCT Pub. No.: WO2019/236111

PCT Pub. Date: Dec. 12, 2019

(65) Prior Publication Data

US 2021/0114383 A1 Apr. 22, 2021

(51) Int. Cl.
*B41J 11/00* (2006.01)
*B41J 13/02* (2006.01)
(Continued)

(52) U.S. Cl.
CPC ..... *G03G 15/2053* (2013.01); *B41J 11/0024* (2021.01); *B41J 11/00242* (2021.01);
(Continued)

(58) Field of Classification Search
CPC ..... B41J 11/0024; B41J 11/00242; B41J 13/025; B41J 13/08; B41J 2/01;
(Continued)

(56) References Cited

U.S. PATENT DOCUMENTS 9,146,509 B2 9/2015 Sato
9,329,538 B2 5/2016 Koda et al.
(Continued)

FOREIGN PATENT DOCUMENTS

CN 107272384 A 10/2017
JP 2008102464 A 5/2008
JP 2009300959 A 12/2009
JP 2017122899 A 7/2017

*Primary Examiner* — Matthew Luu
*Assistant Examiner* — Kendrick X Liu
(74) *Attorney, Agent, or Firm* — Brooks Cameron & Huebsch PLLC

(57) ABSTRACT

In some examples, a system is disclosed that includes a roller assembly for a printer. The roller assembly includes a pressure roller, a belt coupled, a drive assembly to rotate the pressure roller and to urge the pressure roller into the belt, a heater to apply heat to the belt, and a temperature sensor to detect a temperature of the belt. In addition, the roller assembly includes a controller to increase a pressure applied to the pressure roller from a first to a second pressure in pressure in response to a temperature of the belt being greater than or equal to a first temperature threshold. Also, the controller is to initiate an advance of a print media to contact the belt in response to the temperature of the belt being greater than or equal to a second, higher temperature threshold.

15 Claims, 4 Drawing Sheets

(51) Int. Cl.

| | |
|---|---|
| ***B41J 13/08*** | (2006.01) |
| ***G03G 13/20*** | (2006.01) |
| ***G03G 15/20*** | (2006.01) |

(52) U.S. Cl.

CPC ..... *B41J 13/02* (2013.01); *B41J 13/025* (2013.01); *B41J 13/08* (2013.01); *G03G 13/20* (2013.01); *G03G 15/205* (2013.01); *G03G 15/2032* (2013.01); *G03G 15/2064* (2013.01)

(58) Field of Classification Search

CPC ..... G03G 13/20; G03G 15/2003; G03G 15/2014; G03G 15/2017; G03G 15/2032; G03G 15/2039; G03G 15/205; G03G 15/2053; G03G 15/2064

See application file for complete search history.

(56) References Cited

U.S. PATENT DOCUMENTS

| | | | | |
|---|---|---|---|---|
| 9,483,002 | B2 | 11/2016 | Hazeyama et al. | |
| 2010/0290796 | A1 | 11/2010 | Sato | |
| 2011/0135355 | A1* | 6/2011 | Baba | G03G 15/2053 399/329 |
| 2012/0093547 | A1* | 4/2012 | Baba | G03G 15/2032 399/329 |
| 2012/0301161 | A1 | 11/2012 | Fujimoto | |
| 2013/0223903 | A1* | 8/2013 | Matsuura | G03G 15/2025 399/329 |
| 2014/0064763 | A1* | 3/2014 | Watanabe | G03G 15/2064 399/67 |
| 2017/0185013 | A1 | 6/2017 | Minagawa et al. | |
| 2017/0219973 | A1 | 8/2017 | Hadano | |
| 2017/0242376 | A1 | 8/2017 | Tsujibayashi et al. | |

* cited by examiner

HEATED PRESSURE ROLLER ASSEMBLIES FOR PRINTERS

BACKGROUND

Printers include a number of different rollers and roller assemblies for performing a variety of tasks and functions. Most basically, these sorts of devices and assemblies are utilized to advance the print media (e.g., paper) through the printer and, in some cases, condition the print media for printing or finishing operations.

BRIEF DESCRIPTION OF THE DRAWINGS

Various examples are described below referring to the following figures.

DETAILED DESCRIPTION

Figure 1:
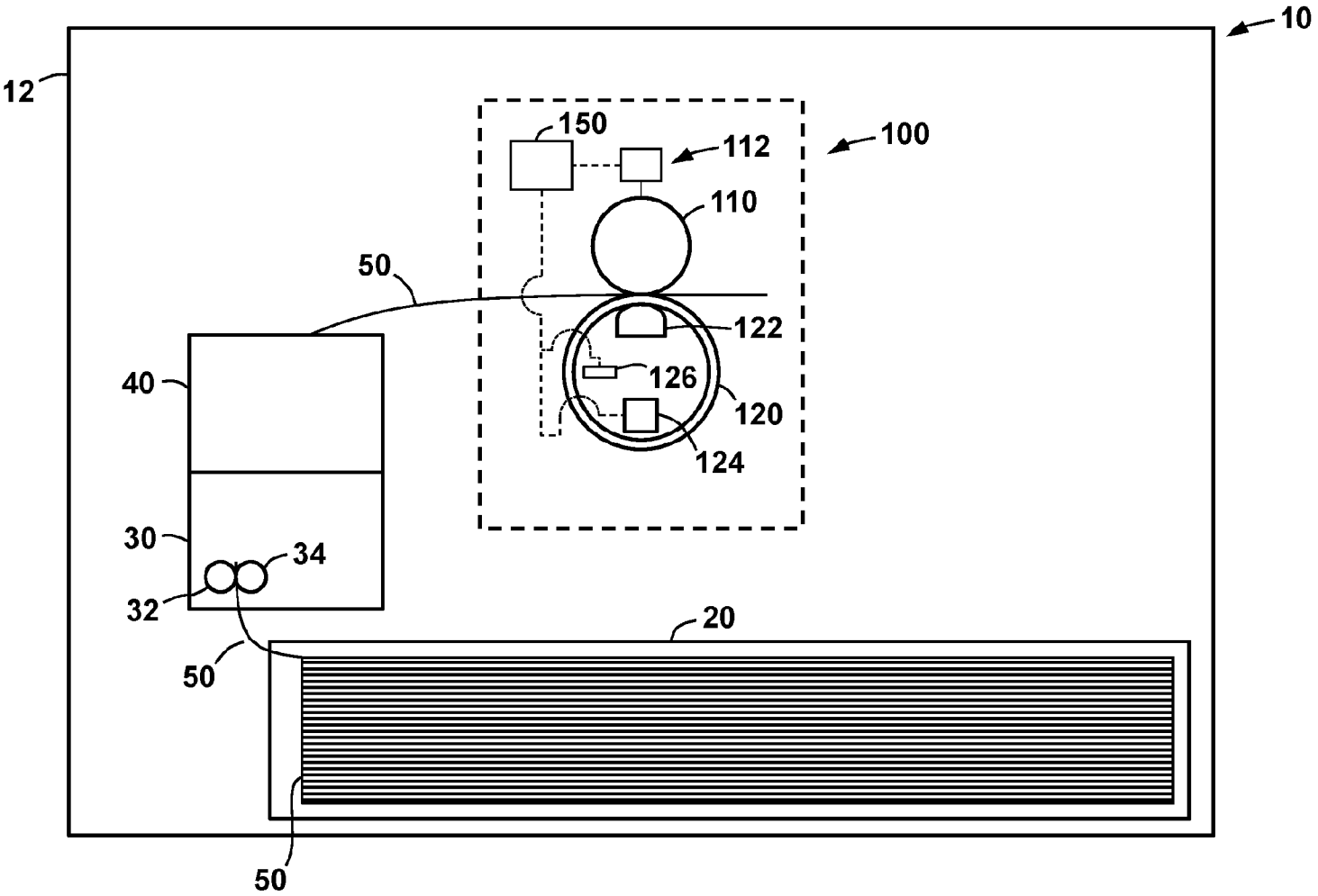
FIG. 1 shows a schematic view of a printer in accordance with various examples.

In the figures, certain features and components disclosed herein may be shown exaggerated in scale or in somewhat schematic form, and some details of certain elements may not be shown in the interest of clarity and conciseness. In some of the figures, in order to improve clarity and conciseness, a component or an aspect of a component may be omitted.

In the following discussion and in the claims, the terms "including" and "comprising" are used in an open-ended fashion, and thus should be interpreted to mean "including, but not limited to . . . ." Also, the term "couple" or "couples" is intended to be broad enough to encompass both indirect and direct connections. Thus, if a first device couples to a second device, that connection may be through a direct connection or through an indirect connection via other devices, components, and connections. In addition, as used herein, the terms "axial" and "axially" generally refer to positions along or parallel to a central or longitudinal axis (e.g., central axis of a body or a port), while the terms "lateral" and "laterally" generally refer to positions located or spaced to the side of the central or longitudinal axis.

As used herein, including in the claims, the word "or" is used in an inclusive manner. For example, "A or B" means any of the following: "A" alone, "B" alone, or both "A" and "B." In addition, when used herein including the claims, the word "generally" or "substantially" means within a range of plus or minus 20% of the stated value. As used herein, the terms "downstream" and "upstream" are used to refer to the arrangement of components and features within a printer with respect to the "flow" of print media through the printer during a printing operation. Thus, if a first component of a printer receives print media after it is output from a second component of the printer during a printing operation, then the first component may be said to be "downstream" of the second component and the second component may be said to be "upstream" of the first component.

As previously described, printers include a number of roller assemblies for advancing print media therethrough during printing operations. In some of these roller assemblies, lubricant is used to facilitate operation (e.g., rotation) of the roller(s) therein. One example of a such a roller assembly is a heated pressure roller assembly commonly used within an inkjet printer. Upon initial startup of a printer (e.g., such as when a print command is received from a computing device), the lubricants of such a roller assembly may be at a relatively low temperature, and thus may be relatively viscous, such that the input torque used to drive rotation of the rollers may be relatively high. This increased torque may cause damage or increased wear to the roller drivers (e.g., motors) or other components within the roller assembly, thereby ultimately resulting in a decreased service life for such components. This issue is further exacerbated by a desire within the printing industry to maximize the speed that printers complete a printing operation, since this assumes the roller assemblies within the printer initiate operation relatively quickly after receipt of the initial print command.

One solution to these issues is to utilize more robust (and therefore more expensive) components within the printer roller assemblies that may withstand higher torque loads during operation. However, market considerations fuel the need to decrease the purchase price for printers, and this frustrates the ability of printer manufacturers to simply overdesign the roller assemblies within the printer to withstand such enhanced loads. Accordingly, examples disclosed herein include roller assemblies (e.g., such as heated pressure roller assemblies) for use within a printer and operation procedures therefor that minimize the loads placed on the roller assembly while also minimizing the time to initiate a printing operation. Thus, through use of the example roller assemblies disclosed herein (including operational procedures disclosed therefor), a printer manufacturer may utilize less robust components within the roller assemblies of the printer so as to produce a printer that has both an acceptable service life and purchase price.

Referring now to FIG. 1, a printer 10 including a heated pressure roller (HPR) assembly 100 is schematically shown. In addition to HPR assembly 100, printer 10 also includes a housing 12, a storage area 20, a holding area 30, and a printing assembly 40.

Storage area 20 is a compartment or tray that is sized and arranged to hold pages of print media 50, so that the print media 50 may be accessed by printer 10 to perform printing operations (therefore in some examples, storage area 20 may be referred to as a storage tray). Holding area 30 is "downstream" from the storage area 20, in that print media 50 is advanced from storage area 20 to holding area 30 during a printing operation. Holding area 30 is to receive and hold print media 50 therein until printer 10 is able and ready to receive print media into printing assembly 40 and other assemblies that are downstream from holding area 30 (e.g., HPR assembly 100). Thus, holding area 30 includes rollers that are arranged to contact and hold print media 50 within area 30 and are controllable to selectively advance print media 50 toward downstream assemblies (e.g., printing assembly 40, HPR assembly 100, etc.). To illustrate this, holding area 30 is depicted with a pair of rollers 32, 34 that contact and capture print media 50 therebetween (although it will be appreciated that the arrangement and number of the rollers or other print media contact components within holding area 30 will vary widely in different examples). When a determination is made to advance print media 50 toward printing assembly 40 (e.g., by controllers associated with printer 10), one or both of rollers 32, 34 are rotated to thereby facilitate and drive the advance of the print media 50 toward printing assembly 40 and HPR assembly 100 (in addition to any other assemblies that may be disposed within printer 10 that are downstream of holding area 30).

Printing assembly 40 is an assembly (or collection of assemblies) within printer 10 that is to affix or print an image on print media 50 as it is advanced therethrough. Printing assembly 40 may generally employ any suitable printing technique, such as, for example, inkjet printing, laser printing, phase-change printing, dye-sublimation printing, thermal printing, impact printing, etc. In this example, printing assembly 40 is an inkjet printing assembly that is arranged to fix or dispose an image on the print media 50 by propelling small drops (i.e., droplets) of liquid ink onto the surface of the print media 50 from ink cartridges (not shown). Once print media 50 has the desired image affixed to it with printing assembly 40, it is advanced (either directly or indirectly) to HPR assembly 100.

HPR assembly 100 generally serves to condition the print media 50 following the exit of the print media 50 from printing assembly 40. For example, HPR assembly 100 applies heat to the print media 50 in order to partially or completely dry ink that is applied to the print media 50 within printing assembly 40. The specific components of HPR assembly 100 (and their function) will now be described in more detail below.

Figure 2:
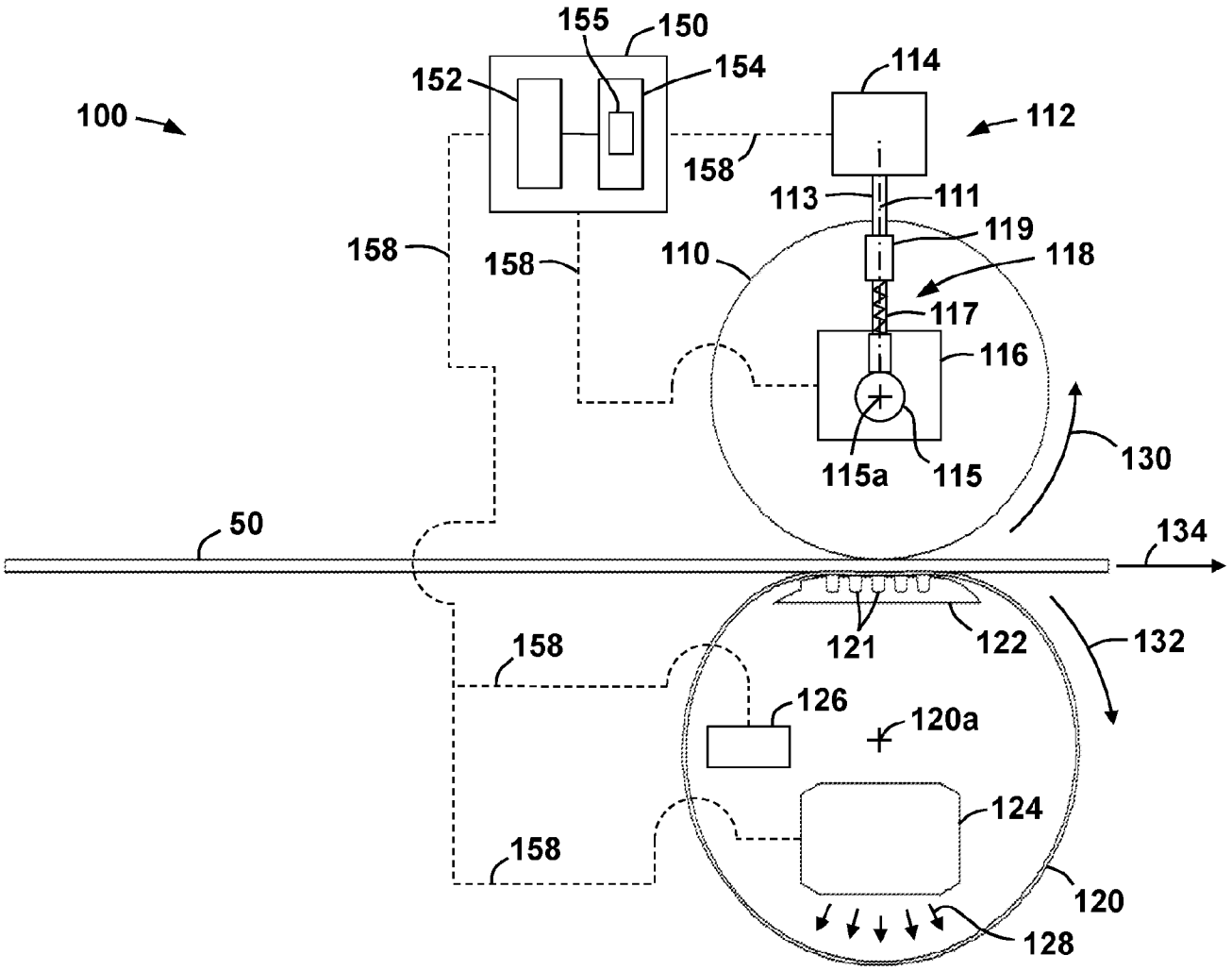
FIG. 2 shows a schematic view of a heated pressure roller assembly of the printer of FIG. 1.

Referring now to FIG. 2, HPR assembly 100 generally includes a pressure roller 110, a belt 120, a platen 122, a drive assembly 112, and a heater 124. Pressure roller 110 is a cylindrical member that is to rotate about a longitudinal axis 115*a* of a central shaft 115 during operations. The rotation of pressure roller 110 about axis 115*a* of shaft 115 is driven by drive assembly 112, the details of which will be described in more detail below.

Belt 120 is a continuous loop of suitable material (such as, for example, a metallic material coated in a perfluoroalkoxy polymer resin) that is disposed across platen 122 within HPR assembly 100 such that belt 120 is caught or pinched between pressure roller 110 and platen 122 during operations. As a result, when pressure roller 110 is rotated about axis 115*a* in the manner described above, belt 120 is also rotated generally about an axis 120*a* that is parallel to and laterally spaced from axis 115*a*. As a result, when roller 110 is rotated about axis 115*a* in a first direction 130 (which is shown as a counterclockwise rotation in FIG. 2), belt 120 is driven to rotate in an opposite direction 132 (which is shown as a clockwise rotation in FIG. 2) due to the engagement and resulting friction between belt 120 and pressure roller 110.

As belt 120 is rotated about axis 120*a* by pressure roller 110 as previously described above, belt 120 slides against platen 122. Platen 122 includes a plurality of grooves or channels 121 that house or contain lubricant (e.g., grease, oil, etc.) therein. As a result, during the above described rotation of pressure roller 110 and belt 120, the lubricant is drawn out of channels 121 and is disposed between belt 120 and platen 122 to lubricate the sliding engagement between belt 120 and platen 122. While not specifically shown, a lubricant injection or supply system may also be included within printer 10 that actively or passively provides additional (or makeup) lubricant to channels 121 or between platen 122 and belt 120 so that there is a sufficient amount lubricant between platen 122 and belt 120 during printing operations.

Referring still to FIG. 2, drive assembly 112 includes a first driver 116 and a second driver 114. Each of the first driver 116 and second driver 114 may comprise a motor (or collection of motors) that are driven (e.g., by a controller or other suitable device) to actuate (e.g., rotate, reciprocate, etc.) an output shaft to thereby facilitate various functions within HPR assembly 100 during operations. In particular, drivers 114, 116 may comprise electric motors (e.g., servo motors) that are to actuate their respective output shafts via electrical signals from a controller (e.g., control assembly 150 described in more detail below).

Driver 116 is coupled to shaft 115 and thus drives rotation of shaft 115 and pressure roller 110 about axis 115*a*. Driver 114 includes an output shaft 113 that is coupled to a pressure adjustment assembly 118 (or more simply pressure assembly 118) that applies an adjustable pressure to roller 110 along an axis 111 that extends perpendicularly or orthogonally to axis 115*a*. Thus, driver 114 applies an adjustable force to pressure roller 110 that translates to an adjustable pressure applied by pressure roller 110 to belt 120 and platen 122 via pressure assembly 118, during printing operations.

In this example, driver 114 is to rotate shaft 113 about axis 111, and therefore, pressure assembly 118 may comprise any suitable device or assembly to convert a rotation of shaft 113 about axis 111 into an axial movement or force along axis 111. In particular, in this example, pressure assembly 118 includes a cam assembly 119, and a biasing member 117. In this example, biasing member 117 comprises a linear spring that applies a varying spring force along axis 111 due to relative axial displacement of the terminal ends of member 117 along axis 111. Cam assembly 118 includes cams (not specifically shown), that are rotatable relative to one another about axis 111 to thereby translate one terminal end of biasing member 117 relative to the other terminal end thereof. Specifically, in this example, rotation of shaft 113 about axis 111 causes the cams of cam assembly 119 to rotate relative to others of the cams within cam assembly 119 about axis 111. This relative rotation of the cams in assembly 119 causes a change in an axial length of cam assembly along axis 111, which in turn translates one terminal end of biasing member 117 relative to the other terminal end thereof along axis 111. Therefore, rotation of shaft 113 about axis 111 causes biasing member 117 to apply a changing (or adjustable) biasing force to pressure roller 110 (either directly or indirectly) along axis 111.

It should be appreciated that adjustable pressure assembly 118 may include any suitable components to facilitate the adjustable axial force as described above (and may therefore not include cam assembly 119 or spring 117 as described above). In addition, it should also be appreciated that in other examples, driver 114 may be arranged to translate shaft 113 along axis 111 (e.g., reciprocate), and therefore, adjustable pressure assembly 118 may be omitted in these examples.

Referring still to FIG. 2, heater 124 is disposed proximate belt 120 and selectively applies heat energy 128 to belt 120 during operation of printer 10. In particular, heater 124 applies heat to belt 120, and this heat is then transferred to roller 110, platen 122, and print media 50 as a result of the rotation of the belt 120 during a printing operation. The heat applied by heater 124 serves a variety of functions within HPR assembly 100. For example, the heat applied by heater 124 dries some (or all) of the ink applied to the print media 50 within printing assembly 40 prior to the print media exiting from printer 10. In addition, the heat applied by heater 124 also serves to increase the temperature of the lubricant disposed between platen 122 and belt 120, which thereby reduces the viscosity thereof. This decrease in lubricant viscosity serves to decrease the input torque to drive rotation of roller 110 and belt 120 during operations.

Heater 124 may comprise any suitable device (or devices) that output heat energy 128 that may be applied to belt 120 during operations. In addition, heater 124 may apply heat energy to belt 120 via any of radiative, convective, or conductive heat transfer modalities. In this example, heater 124 comprises a halogen lamp that applies heat to belt 120 via radiative (and potentially convective) heat transfer. A temperature sensor 126 is also included within HPR assembly 100 and is to sense the temperature of belt 120 (or a section or length of belt 120) during operations. Heat sensor 126 may comprise any suitable device for measuring or sensing heat on a surface, such as, for example, a thermocouple, thermistor, etc. In this example, heat sensor 126 comprises a thermistor.

HPR assembly 100 also includes a controller 150 coupled to each of the drivers 114, 116 of driver assembly 112, heater 124, and temperature sensor 126. Generally speaking, controller 150 receives signals from heat sensor 126, and controls the operation of drivers 114, 116, and heater 124 during operations of printer 10. Controller 150 may be a dedicated controller for HPR assembly 100 or may be included within a central controller or control assembly for printer 10. In this example, controller 150 is a dedicated controller for HPR assembly 100 and is able to communicate with other controllers or control assemblies within printer 10 (e.g., such as those that facilitate operation of printer assembly 40, as well as components within holding area 30 and storage area 20). The specific component and functions of controller 150 will now be described in detail below with continued specific reference to FIG. 2.

In particular, controller 150 may comprise any suitable device or assembly which is capable of receiving an electrical or mechanical signal and transmitting various signals to other devices (e.g., drivers 114, 116, heater 124, sensor 126, etc.). In particular, as shown in FIG. 2, in this example, controller 150 includes a processor 152 and a memory 154.

The processor 152 (e.g., microprocessor, central processing unit, or collection of such processor devices, etc.) executes machine-readable instructions 155 provided on memory 154, and upon executing the machine-readable instructions 155 on memory 154 provides the controller 150 with all of the functionality described herein. The memory 154 may comprise volatile storage (e.g., random access memory), non-volatile storage (e.g., flash storage, read only memory, etc.), or combinations of both volatile and non-volatile storage. Data consumed or produced by the machine-readable instructions 155 can also be stored on memory 154.

Controller 150 is coupled or linked to each of the drivers 114, 116, temperature sensor 126, and heater 124 by a plurality of conductors 158, which may comprise any suitable conductive element for transferring power and/or control signals (e.g., electrical signals, light signals, etc.). For example, in some examples, conductors may comprise conductive wires (e.g., metallic wires), fiber optic cables, or some combination thereof. In other examples, controller 150 is to communicates with each of the drivers 114, 116, temperature sensor 126, and heater 124 via wireless connections (e.g., WIFI, BLUETOOTH®, near field communication, infrared, radio frequency communication, etc.).

During operations, controller 150 actuates drivers 114, 116 to rotate shafts 113, 115, respectively to facilitate rotation of roller 110 and belt 120 and to urge pressure roller 110 into engagement with belt 120 and platen 122 as previously described. In addition, controller 150 actuates heater 124 to emit heat energy 128 to belt 120. Further, controller 150 actuates temperature sensor 126 to take readings or measurements of the temperature of belt 120 and to receive output signals (which may be referred to herein as temperature signals) from sensor 126 that include or are indicative of the temperature sensed or measured by sensor 126.

Referring again to FIGS. 1 and 2, during printing operations, a piece of print media 50 is advanced to belt 120 and pressure roller 110 and caught or pinched therebetween. Controller 150 rotates pressure roller 110 about axis 115*a* in direction 130 and applies pressure between pressure roller 110 and belt 120 to cause rotation of belt 120 in direction 132 via operational control of drivers 116, 114 as previously described. When print media 50 is pinched between pressure roller 110 and belt 120 and roller and belt 120 are rotated in directions 130 and 132, respectively as shown in FIG. 2, print media is advanced in direction 134 toward the exit of printer 10 (see FIG. 1). In addition, during these operations, heat 128 is applied to belt 120 via heater 124 and that heat is transferred to print media 50 as a result of the contact between belt 120 and print media 50. As previously described, this heat applied to print media 50 works to partially or totally dry ink disposed on print media within printing assembly 40 prior to print media 50's exit from printer 10.

Figure 3:
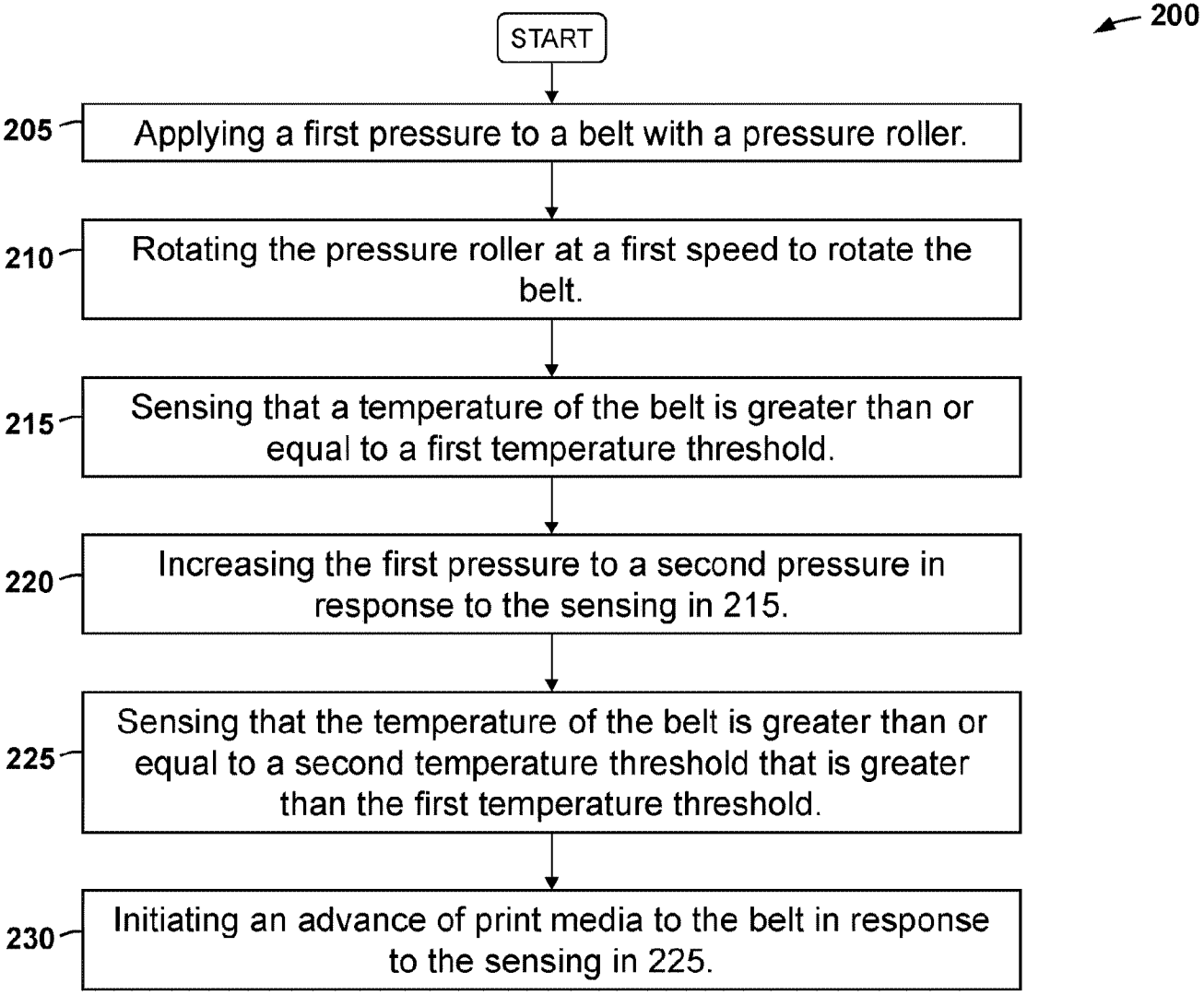
FIG. 3 shows a diagram of a method for operating a heated pressure roller assembly in accordance with various examples.

Referring now to FIG. 3, a method 200 of operating a heated pressure roller assembly (e.g., HPR assembly 100) during a printing operation of a printer (e.g., printer 10) is shown. In describing the features of method 200, specific reference is made to the features and components of printer 10, including HPR assembly 100, shown in FIGS. 1 and 2. However, it should be appreciated that such specific reference is merely made to enhance understanding of method 200 and is not intended to limit the application of method 200. As a result, it should also be appreciated that method 200 may be performed with components and features that differ from those shown and described above for printer 10 and HPR assembly 100.

As shown in FIG. 3, method 200 includes applying a first pressure to a belt with a pressure roller at 205. The first pressure may be a relatively light pressure that serves as a minimum pressure to facilitate sufficient frictional engagement between the pressure roller and the belt to allow rotation of belt with the pressure roller. For instance, in the example of FIGS. 1 and 2, a first pressure may be applied to belt 120 with pressure roller 110 by actuation of driver 114 by controller 150. Specifically, controller 150 may actuate driver 114 to rotate shaft 113 and thus apply a first pressure to roller 110 and belt 120 via pressure adjustment assembly 118 in the manner previously described above.

Returning to FIG. 3, method 200 additionally includes rotating the pressure roller (e.g., pressure roller 110) at a first speed to rotate the belt (e.g., belt 120) at 210. The first speed may be a non-zero speed that is relatively slow to first initiate movement of the pressure roller and the belt in preparation of contacting print media (e.g., print media 50) later on. In some specific examples, the first speed of the pressure roller may be selected to result in a linear speed of print media (assuming print media were being driven by the rotating pressure roller and belt) that ranges from approximately 3 inches per second (ips) to approximately 5 ips.

Method 200 further includes sensing that a temperature of the belt is greater than or equal to a first temperature threshold at 215. In some examples, the first temperature threshold is chosen to ensure a minimum temperature (and thus viscosity) of lubricant disposed between the belt and a belt platen (e.g., platen 122) to maintain torque loads for driving rotation of the pressure roller (e.g., pressure roller 110) at acceptable levels. As a result, in some examples, the first temperature threshold may vary depending on the composition of the lubricant used, as well as the type, size, and properties of the belt, heater, platen, etc. Specifically, in some examples, the first temperature threshold may equal approximately 50° C. When applying box 215 to the example of FIGS. 1 and 2, a temperature of the belt 120 may be sensed by temperature sensor 126 and a temperature signal may be output by sensor 126 and sent to controller 150 via the corresponding conductor 158. Controller 150 may then determine whether the temperature sensed by sensor 126 is greater than or equal to the predetermined first temperature threshold.

Returning again to FIG. 3, method 200 next includes increasing the first pressure to a second pressure at 220 in response to the sensing that the temperature of the belt is greater than or equal to the first temperature threshold at 215. In some examples, the second pressure is higher than the first pressure and is chosen to result in a sufficient frictional engagement between the pressure roller and the belt to effectively capture and drive advancement of print media (e.g., print media 50) therebetween. As previously described, the first temperature threshold of the belt is chosen to result in a desired viscosity of lubricant and therefore to maintain an acceptable torque for rotation of the pressure roller. Therefore, upon determining that the first temperature threshold of belt has been achieved (or surpassed) in 215, it may further be determined that an increase in pressure to the second pressure may be also be performed while still maintaining an acceptable torque load for rotation of the pressure roller. When applying box 220 to the example of FIGS. 1 and 2, controller 150 increases the pressure applied by the roller 110 to belt 120 from the first pressure to the second pressure by actuating driver 116 to rotate shaft 113 and therefore increase the biasing force applied by biasing member 117 via cam assembly 119, as previously described.

Returning again to FIG. 3, method 200 includes sensing that the temperature of the belt is greater than or equal to a second temperature threshold that is greater than the first temperature threshold at 225. The second temperature threshold may be chosen to ensure proper functionality of the roller assembly during printing operations with a print media (e.g., print media 50). For example, in some instances the second temperature threshold is chosen to ensure that when a print media is pinched between the belt and pressure roller, sufficient heat is transferred to the print media so as to dry (partially or totally) ink disposed on the print media. As a result, in these examples, the second temperature threshold may be chosen based on variety of factors such as the composition of the ink applied to the print media by the printing assembly (e.g., printing assembly 40), the amount of ink disposed on the print media by the printing assembly, the speed with which the print media is advanced through the printer, the design of the roller, belt and belt platen, etc. When applying box 225 to the example of FIGS. 1 and 2, sensing the temperature of the belt 120 may correspond with controller 150 receiving a temperature signal from temperature sensor 126 via conductor in the same manner previously described.

Referring still to FIG. 3, method 200 finally includes initiating an advance of the print media to the belt at 230 in response to the sensing at 225. As previously described, the second temperature threshold is chosen to ensure proper functionality of the roller assembly during printing operations with a print media (e.g., print media 50). Thus, one it is determined that the temperature of the belt has achieved (or surpassed) the second temperature threshold, it can also be further determined that print media may be advanced toward the belt during a printing operation. As used herein, initiating and advance of print media toward the belt refers to advancing the print media into contact with the belt and includes advancing the print media into and through other intervening components, assemblies, and stages in route to the belt. Therefore, in applying box 230 to the example of FIGS. 1 and 2, controller 150 may initiate an advance of the print media 50 toward belt 120 by: (1) directly controlling or operating rollers (or other print media advancing devices) in holding area 30 or storage area 20 to advance print media 50 into printing assembly and then on to the HPR assembly 100; or (2) sending a command or other signal to another controller or control unit within printer 10, that then in turn controls or operates the rollers in either storage area 20 or holding area 30 to advance of the print media to printing assembly and then on to the HPR assembly 100.

Therefore, through use of method 200, the pressure applied by a pressure roller to a belt of a roller assembly (e.g., such as a heated pressure roller assembly 100) of a printer and the release timing of the print media to the roller assembly may be directly tied to the temperature of the belt. As a result, both the torque to drive rotation of the pressure roller and belt and the time to advance print media through the printer may be optimized (e.g., minimized). In addition, it should be appreciated that the application of heat at box 312 increases the belt temperature from an initial or starting temperature to the first temperature threshold at 318, 320 and then subsequently to the second temperature threshold at 330. In some examples, the increase of the belt temperature as a result of the heat applied at box 312 to the first temperature threshold and then the second temperature threshold is continuous (i.e., the temperature of the belt continuously increases from the initial temperature to the first temperature threshold and then to the second temperature threshold).

Figure 4:
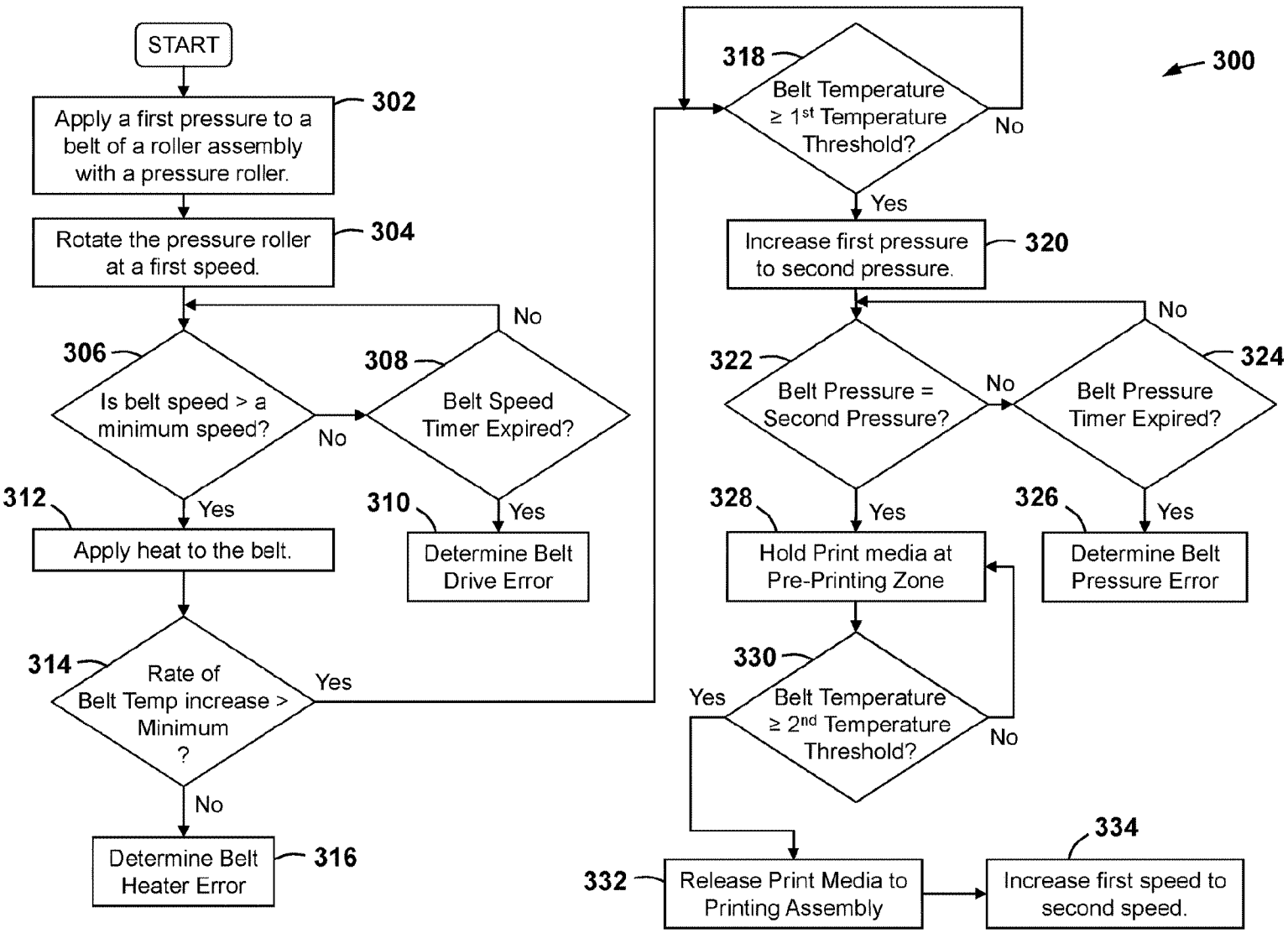
FIG. 4 shows a diagram of another method for operating a heated pressure roller assembly in accordance with various examples.

Referring now to FIG. 4, a method 300 of conducting a printing operation with a printer is shown. As with method 200, in describing the features of method 300, specific reference will be made to the example of FIGS. 1 and 2; however, it should be appreciated that method 300 may be practiced with devices and components that differ from the example in FIGS. 1 and 2. Therefore, specific references to the components and features of printer 10 and HPR assembly 100 of FIGS. 1 and 2 are merely made to enhance the understanding of method 300.

Initially, method 300 includes applying a first pressure to a belt (e.g., belt 120) of a roller assembly (e.g., HPR assembly 100) with a pressure roller (e.g., pressure roller 110) at 302 and rotating the pressure roller at a first speed at 304. The "first pressure" and the "first speed" of boxes 302 and 304 respectively, correspond with the "first pressure" and "first speed" of boxes 210 and 205 of method 200, previously described (see FIG. 3), and thus, the same description with respect to these features applies for method 300 and is not repeated in the interests of conciseness and brevity.

Referring still to FIG. 4, method next includes a determination at 306 as to whether the speed of the belt is greater than a minimum speed. The minimum speed may equal or correspond to (e.g., is proportional to) the first speed. The belt speed may be measured by any suitable device (e.g., such as a sensor disposed proximate belt). If the belt speed is determined to not be greater than the minimum speed, a second determination is made at 308 as to whether belt speed timer has expired. For example, with reference to FIGS. 1 and 2, the controller 150 may initiate a belt speed timer either simultaneously or after initiating rotation of pressure roller 110 via driver 114. Returning to FIG. 4, if the belt speed timer has not expired (i.e., the determination at 308 is "no") then method 300 returns to determination 306 (which determinations whether the belt speed is greater than the minimum speed); however, if the determination at 308 is that the belt timer has indeed expired (i.e., the determination at 308 is "yes"), then it is determined at 310 that there is an error or failure in the belt drive. For example, with reference to FIGS. 1 and 2, if it is determined that the belt 120 is not rotating at a minimum speed following expiration of a belt speed time after initiating rotation of roller 110, controller 150 may determine that there is an error associated with the rotation of belt 120 (which may call for additional logic and diagnostics to further define).

If, on the other hand, the determination at 306 is that the belt speed is indeed greater than a minimum speed, then method 300 progresses to apply heat to the belt at 312. The combination of determinations 306, 308 and boxes 310, 312 help to ensure that heat is not applied to the belt until it is determined that the belt is properly rotating, so that an overheating of one portion of the belt is avoided. For example, referring specifically again to the example of FIGS. 1 and 2, heater 124 applies heat energy 128 to a portion of the belt 120. Because belt 120 is rotated via contact with pressure roller 110 as previously described, the heat energy 128 applied by heater 124 is distributed along the entire belt 120. However, if, for some reason, the belt 120 were not rotating properly, the heat energy 128 would be applied in one concentrated location along belt 120, which may ultimately lead to failure (e.g., melting) of the belt 120. Because belt 120 can be relatively expensive component of HPR assembly 100, failure of the belt 120 should be avoided during printing operations.

Returning again to FIG. 4, following 312, method 300 includes determining whether a rate of temperature increase of the belt is greater than a minimum value at 314. If the rate of temperature increase is equal to or below the minimum value (i.e., the determination in 314 is "no") then a determination is made at 316 that there is an error or failure in the belt heater (e.g., heater 124). If, on the other hand, the rate of temperature increase of the belt is greater than the minimum value (i.e., the determination in 314 is "yes"), the method 300 proceeds forward. The minimum value of the belt temperature increase may be selected based on the design specifications of the heater used to apply heat to the moving belt (e.g., heater 124), and based upon other physical parameters of the printing system (e.g., the speed of the belt). For the example of FIGS. 1 and 2, controller 150 may make the determination in 314 by monitoring the temperature signals output by temperature sensor 126 over a predetermined period of time and comparing those signals to the pre-determined minimum belt increase rate (e.g., that may be stored on memory 154).

Referring again to FIG. 4, method next determines whether the temperature of the belt is greater than or equal to a first temperature threshold (or "$1^{st}$ temperature threshold" as shown in FIG. 4). The "first temperature threshold" corresponds with the "first temperature threshold" in box 215 of method 200 in FIG. 3, and thus, the same description with respect to this feature applies for method 300 and is not repeated in the interests of conciseness and brevity. If it is determined that the belt temperature is not greater than or equal to the first temperature threshold (i.e., the determination at 318 is "no"), then the determination in 318 is repeated. If, on the other hand, it is determined that the belt temperature is indeed greater or equal to the first temperature threshold (i.e., the determination at 318 is "yes"), then method 300 proceeds to increase the first pressure to the second pressure at 320. The "second pressure" corresponds with the "second pressure" in box 220 of method 200 in FIG. 3, and thus, the same description with respect to this feature applies for method 300 and is not repeated in the interests of conciseness and brevity.

Next, method 300 includes a determination at 322 as to whether the pressure applied to belt (i.e., the "belt pressure" in FIG. 3) is equal to the "second pressure." The belt pressure may be determined by any suitable device or sensor. For example, with reference to the example of FIGS. 1 and 2, the belt pressure may be determined by a pressure sensor disposed between platen 122 and belt 120 that directly sense the pressure applied to belt 120 via pressure roller 110. In other examples, the pressure applied to belt 120 may be determined by sensing or determining the force applied by the biasing member 117 to roller 110 (e.g., by measuring or determining the axial compression of biasing member 117 or rotation of the cam assembly 118). In still other examples, the belt pressure may be determined by measuring a tension in belt 120 and then calculating (via controller 150) the pressure therefrom.

If it is determined that the belt pressure is not equal to the second pressure in 322 (i.e., the determination at 322 is "no"), then it is determined at 324 whether a belt pressure timer has expired. For example, in the example of FIGS. 1 and 2, controller 150 may initiate a belt pressure timer upon or after changing the pressure applied by roller 110 to belt 120 at 320. As shown in FIG. 4, if it is determined that the belt pressure timer has not expired at 324 (i.e., the determination at 324 is "no") then the determination in 322 (as to whether the belt pressure is equal to the second pressure) is repeated. If, on the other hand, it is determined that the belt pressure timer has indeed expired at 324 (i.e., the determination at 324 is "yes"), then it is determined that there has been a belt pressure error or failure at 326. In other examples, determination 322 of method 300 may instead determine whether the "belt pressure" is equal to or greater than the second pressure.

By contrast, if it is determined at 322 that the belt pressure is equal to the second pressure, then method progresses to 328 where print media (e.g., print media 50) is held within a holding area of the printer. For instance, referring specifically to the example of FIGS. 1 and 2, once the pressure applied by roller 110 to belt 120 is increased to the second pressure as previously described, it may be appropriate to initiate movement of the print media out of storage area 20 and into the holding area 30 (where it is held or pinched between rollers 32, 34) in anticipation of advancing the print media into the printing assembly 40 and finally on to the HPR assembly 100. Thus, controller 150 either directly controls a roller (or rollers) within storage area 20 to cause the advance of print media into the holding area 30, or simply sends an appropriate command or signal to another controller or control assembly that then direct controllers the roller (or rollers within storage area 20 to cause this advance of print media 50.

Referring again to FIG. 4, following 328, method 300 includes determining whether the belt temperature is greater than or equal to the second temperature threshold (or "$2^{nd}$ temperature threshold" as shown in FIG. 4). The "second temperature threshold" in 330 corresponds with the "second temperature threshold" in box 225 of method 200 in FIG. 3, and thus, the same description with respect to this feature applies for method 300 and is not repeated in the interests of conciseness and brevity. If it is determined that the belt temperature is not greater than or equal to the second temperature threshold at 330 (i.e., the determination at 330 is "no"), then box 328 is repeated and print media may be continued to be held at the holding area (e.g., area 30). If, on the other hand, it is determined that the belt temperature is greater than or equal to the second temperature threshold at 330 (i.e., the determination at 330 is "yes"), then method 300 progresses forward to relates the print media from the storage area (e.g., storage area 30) to the printing assembly 40 at 332 and to increase the first speed of the pressure roller to a second speed at 334. The second speed in 334 may be chosen to correspond with the desired advancement rate of the print media through the printer. This speed may change depending on the type of printing selected by a user upon initially sending the print command to the printer, the desired quality of the image being printed, etc. In some specific examples, the second speed of the pressure roller may be selected to result in a linear speed of print media (assuming print media were being driven by the rotating pressure roller and belt) that ranges from approximately 4 ips to approximately 14 ips.

Therefore, through use of method 300, the pressure applied by a pressure roller to a belt of a roller assembly (e.g., such as a heated pressure roller assembly 100) of a printer and the release timing of the print media to the roller assembly may be directly tied to the temperature of the belt. As a result, both the torque to drive rotation of the pressure roller and belt and the time to advance print media through the printer may be optimized (e.g., minimized).

The above discussion is meant to be illustrative of the principles and various examples of the present disclosure. Numerous variations and modifications will become apparent to those skilled in the. It is intended that the following claims be interpreted to embrace all such variations and modifications.

What is claimed is:

1. A system, comprising:

a roller assembly for a printer, the roller assembly comprising a pressure roller, a belt coupled to the pressure roller, a drive assembly to drive rotation of the pressure roller and to urge the pressure roller into the belt, a heater to apply heat to the belt, and a temperature sensor to detect a temperature of the belt; and a controller to:

instruct the drive assembly to apply a first pressure to the pressure roller;

increase the first pressure applied by the drive assembly to the pressure roller to a second pressure that is higher than the first pressure, the increase in pressure in response to the temperature of the belt being greater than or equal to a first temperature threshold; and initiate an advance of a print media to contact the belt in response to the temperature of the belt being greater than or equal to a second temperature threshold that is higher than the first temperature threshold.

2. The system of claim 1, wherein the controller is to rotate the pressure roller at a first speed when the temperature of the belt is less than the first temperature threshold, wherein the first speed is a non-zero speed.

3. The system of claim 2, wherein the controller is to rotate the pressure roller at a second speed in response to the temperature of the belt being greater than or equal to the second temperature threshold, wherein the second speed is greater than the first speed.

4. The system of claim 2, wherein the controller is to trigger the heater to apply heat to the belt after the controller begins rotation of the pressure roller at the first speed.

5. The system of claim 4, wherein the first speed is to advance the print media at appropriately 3 inches of print media per second.

6. The system of claim 1, further comprising an inkjet printing assembly, wherein the inkjet printing assembly is to print an image on the print media and to output the print media to the roller assembly.

7. The system of claim 6, wherein the controller is to initiate an advance of the print media through the inkjet printing assembly and then into contact with the belt in response to the temperature of the belt being greater than or equal to the second temperature threshold.

8. A method, comprising:

applying a first pressure to a belt of a roller assembly for a printer with a pressure roller of the roller assembly;

rotating the pressure roller at a first speed to rotate the belt;

sensing that a temperature of the belt is greater than or equal to a first temperature threshold;

increasing the first pressure to a second pressure in response to the sensing that the temperature of the belt is greater than or equal to the first temperature threshold;

sensing that the temperature of the belt is greater than or equal to a second temperature threshold that is greater than the first temperature threshold; and initiating an advance of a print media to the belt in response to the sensing that the temperature of the belt is greater than or equal to the second temperature threshold.

9. The method of claim 8, further comprising applying heat to the belt to continuously increase the temperature from an initial temperature to the first temperature threshold and then to the second temperature threshold.

10. The method of claim 8, further comprising rotating the pressure roller at a second speed that is greater than the first speed in response to the sensing that the temperature of the belt is greater than or equal to the second temperature threshold.

11. The method of claim 8, further comprising:

applying heat to the belt; and initiating the applying of heat to the belt after rotating the pressure roller at the first speed.

12. The method of claim 8, further comprising:

advancing the print media from a storage area to a holding area;

advancing the print media from the holding area to an inkjet printing assembly in response to sensing that the temperature of the belt is greater than or equal to the second temperature threshold;

printing an image on the print media with the inkjet printing assembly; and advancing the print media to the roller assembly after printing the image.

13. The method of claim 12, further comprising drying ink on the print media by contacting the print media between the belt and the pressure roller.

14. A printer, comprising:

an inkjet printing assembly to apply liquid ink to a print media to print an image thereon;

a roller assembly to receive the print media from the inkjet printing assembly, the roller assembly comprising a pressure roller, a belt coupled to the pressure roller, a drive assembly to drive rotation of the pressure roller and to urge the pressure roller into the belt, a heater to apply heat to the belt, and a temperature sensor to detect a temperature of the belt; and a controller to:

instruct the roller assembly to apply a first pressure to the belt of the roller assembly;

instruct the drive assembly to rotate the belt at a first speed;

instruct the roller assembly to increase the first pressure to a second pressure that is higher than the first pressure, in response to the temperature of the belt being greater than or equal to a first temperature threshold; and initiate an advance of a print media to contact the belt in response to the temperature of the belt being greater than or equal to a second temperature threshold that is higher than the first temperature threshold.

15. The printer of claim 14, wherein the controller is to rotate the pressure roller at a first speed when the temperature of the belt is less than the first temperature threshold, wherein the first speed is a non-zero speed, and wherein the controller is to actuate the heater to apply heat to the belt after the controller begins rotation of the pressure roller at the first speed.

* * * * *